United States Patent [19]

Hayakawa et al.

[11] Patent Number: 4,746,951

[45] Date of Patent: May 24, 1988

[54] COLOR IMAGE FORMING APPARATUS HAVING AN IMPROVED ARRANGEMENT FOR MOUNTING DEVELOPING DEVICES THEREON

[75] Inventors: Kazushi Hayakawa, Tokyo; Noboru Hatakeyama, Kanagawa; Hitoshi Tamura; Tadashi Izawa, both of Tokyo, all of Japan

[73] Assignee: Konishiroku Photo Industry Co., Ltd., Tokyo, Japan

[21] Appl. No.: 926,331

[22] Filed: Nov. 3, 1986

[30] Foreign Application Priority Data

Nov. 11, 1985 [JP] Japan ..... 60-253496
Nov. 11, 1985 [JP] Japan ..... 60-173916[U]

[51] Int. Cl.[4] ..... G03G 15/01
[52] U.S. Cl. ..... 355/4; 355/3 DD
[58] Field of Search ..... 355/3 DD, 4

[56] References Cited

U.S. PATENT DOCUMENTS 4,652,113 3/1987 Watanabe ..... 355/3 DD

*Primary Examiner*—Patrick R. Salce
*Assistant Examiner*—Jeffrey Sterrett
*Attorney, Agent, or Firm*—James E. Nilles; Donald C. McGaughey

[57] ABSTRACT

A color image forming apparatus having a photosensitive drum and a plurality of developing devices. The developing devices are accommodated removably in an integral casing. The integral casing can be held in a fixed position with respect to the photosensitive drum and moved apart from the photosensitive drum. The developing devices can be mounted independently of one another in an adjustable manner or mounting reference members respectively, which are mounted in the integral casing.

5 Claims, 3 Drawing Sheets

COLOR IMAGE FORMING APPARATUS HAVING AN IMPROVED ARRANGEMENT FOR MOUNTING DEVELOPING DEVICES THEREON

BACKGROUND OF THE INVENTION

1. Field of the Invention

The present invention relates to a color image forming apparatus for developing latent images with a plurality of developing units.

2. Description of the Prior Art

The color image forming apparatus is generally equipped, with a plurality of developing units for multicolor developments, and with three developing devices which are charged with red, blue and black toners, respectively, to sequentially develop the latent images, which are formed on a photosensitive drum in response to signals of the respective colors, by applying high-frequency bias voltages thereby to form a color toner image on the photosensitive drum by composing those developed images.

For the aforementioned development by applying the high-frequency bias voltages, each of those developing devices is required to have its built-in developing sleeve positioned at a spacing of as small as 0.4 to 0.5 mm from the circumferential surface of the photosensitive drum and adjusted with a precision of a unit of 0.01 mm and to be freely attached to and detached from the body of the image forming apparatus for toner supplying or cleaning and inspecting operations although it is positioned so close to the photosensitive drum.

In order to satisfy these requirements, however, each of the developing devices has to be mounted on the corresponding mounting portion of the image forming apparatus body through a remarkably high precision fitting device. Adoption of this construction will undesirably deteriorate the commercial value of the image forming apparatus because it enlarges the scale of the construction of the apparatus to raise the production cost and to degrade the operability of mounting and demounting the developing devices.

SUMMARY OF THE INVENTION

An object of the present invention is to provide a color image forming apparatus which is improved to solve the aforementioned problem and which is enabled to attach and detach the individual developing devices simultaneously thereby to set their respective developing rolls in specified positions with respect to the circumferential surface of a photosensitive drum without requiring high-precision fitting devices for fitting the developing devices on the body of the image forming apparatus.

The above-specified object is achieved by a color image forming apparatus for conducting multicolor development with a plurality of developing units, which apparatus is characterized: in that said developing units are accommodated in an integral casing; and in that said integral casing can be held in a fixed position with respect to a photosensitive drum and moved apart from said photosensitive drum.

The above-specified object is also achieved by a color image forming apparatus for conducting multicolor development with a plurality of developing units, which apparatus is characterized: in that said developing units are accommodated in an integral casing; and in that said developing units can be mounted independently of one another in an adjustable manner on mounting reference members respectively, which are mounted in said integral casing; and in that said integral casing is held in a fixed position of the body of said image forming apparatus.

Other objects and features of the present invention will become apparent from the following description taken with reference to the accompanying drawings.

DESCRIPTION OF THE PREFERRED EMBODIMENT

Figure 1:
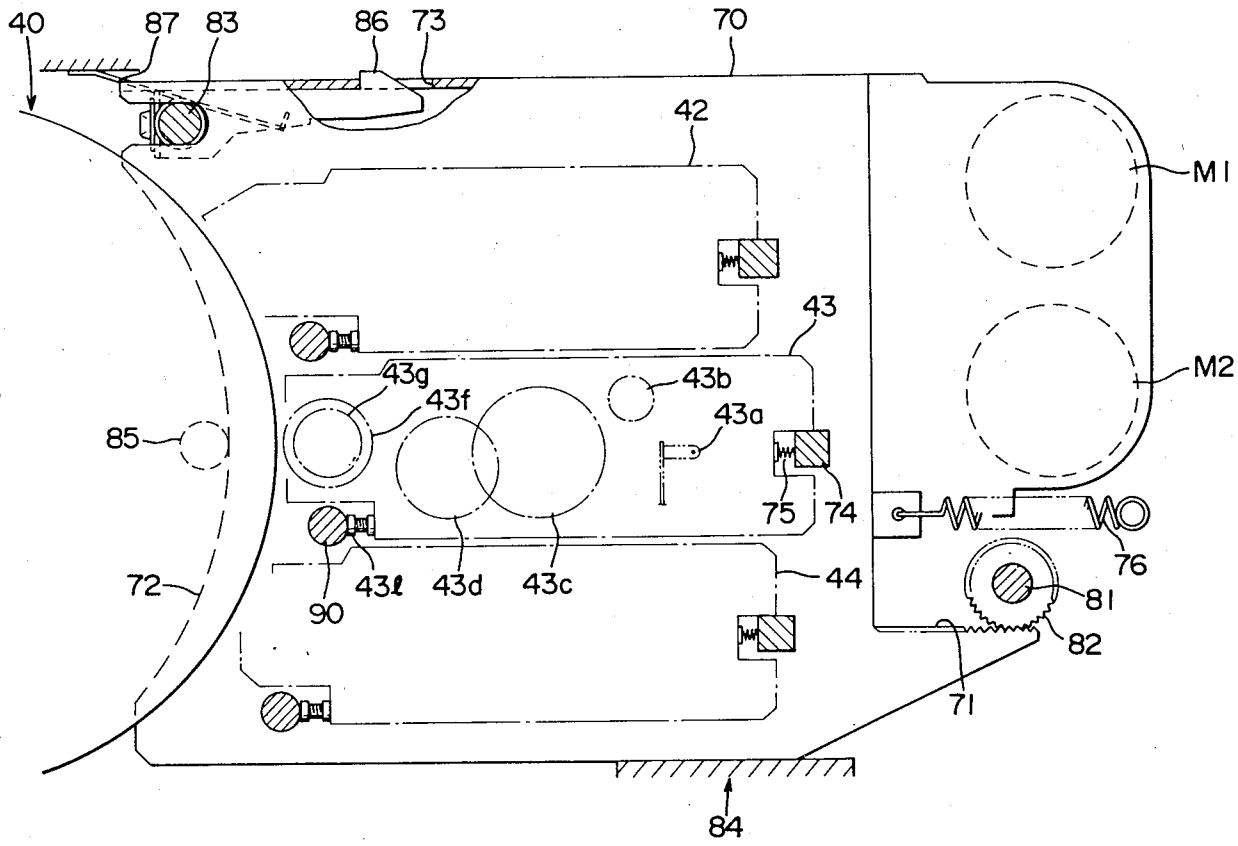
FIG. 1 is a schematic diagram showing an essential portion of the mounting portion of a developing device of a color image forming apparatus according to the present invention.
Figure 2:
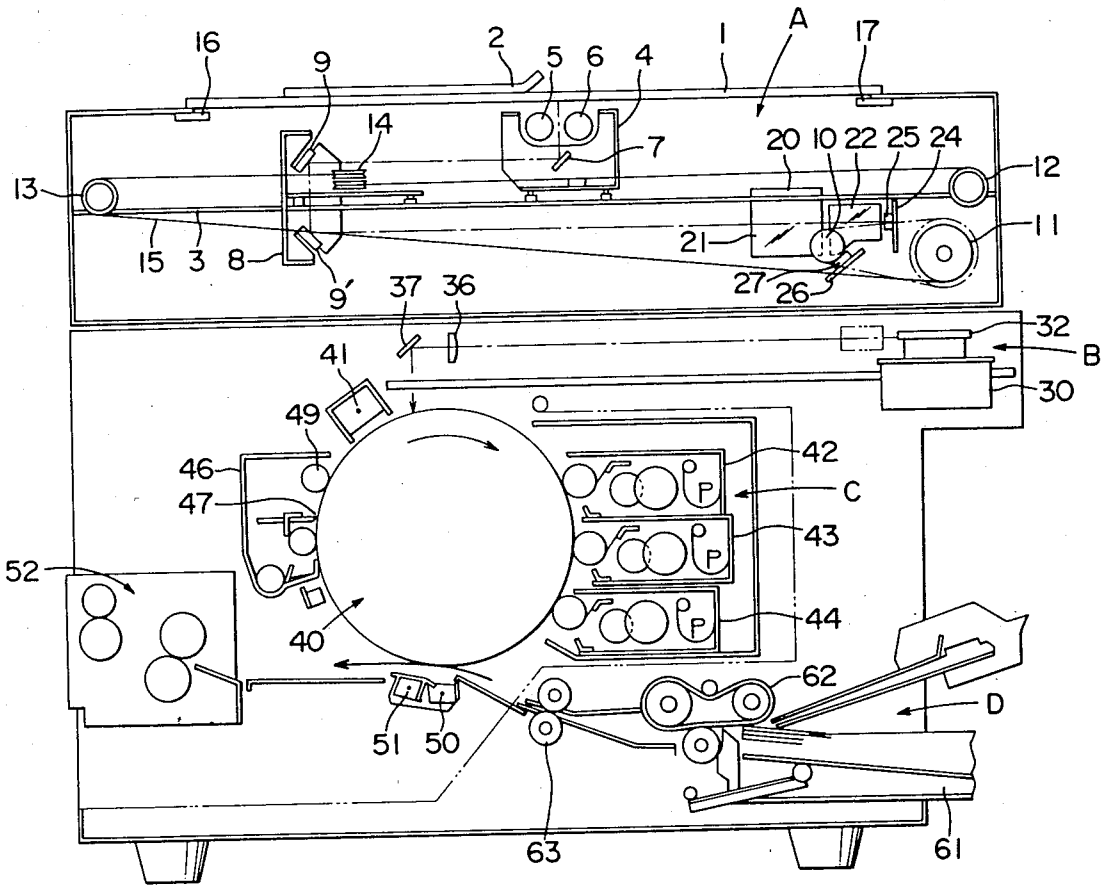
FIGS. 2 and 3 are schematic views showing the color image forming apparatus and the developing device, respectively.
Figure 3:
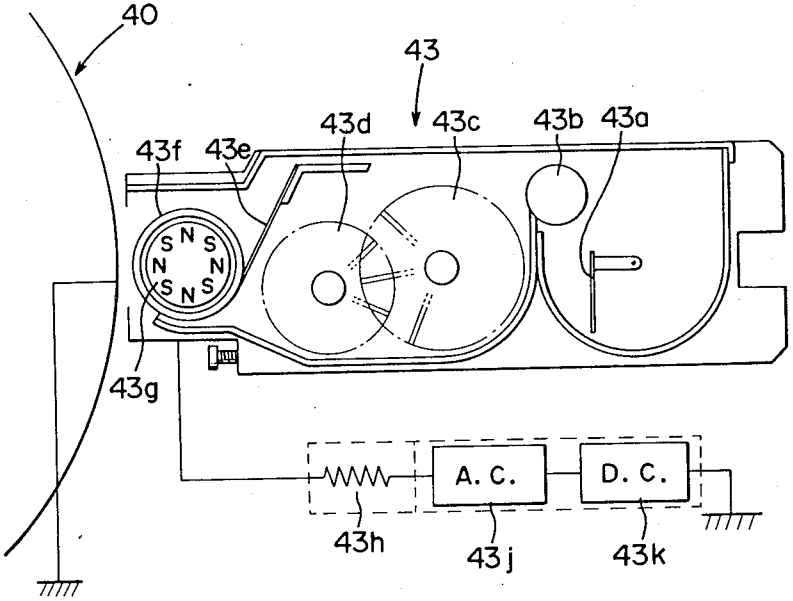

One embodiment of the present invention is shown in FIGS. 1 to 3, of which FIG. 2 shows the construction of the image forming apparatus according to the present invention for forming a color image in the following manner.

In FIG. 2: reference letter A denotes a read unit; letter B a write unit; letter C an image forming unit; and letter D a paper feeding unit.

In the read unit A, reference numeral 1 denotes a platen glass on which is placed an original document 2. This document 2 is irradiated with fluorescent lamps 5 and 6 which are carried by a carriage 4 made movable on slide rails 3. A moving mirror unit 8 is equipped with mirrors 9 and 9' and is made movable on the slide rails 3. The moving mirror unit 8 is combined with a first mirror 7, which is carried on the carriage 4, to extract the optical image of the document 2 on the platen glass 1 to a lens reading unit 20.

The carriage 4 and the moving mirror unit 8 are driven in the same direction at speeds of V and ½ V, respectively, by pulleys 11, 12, 13 and 14 which in turn are driven by a stepping motor 10 through a wire 15. The platen glass 1 has its two end portions equipped on their backs with reference white plates 16 and 17 for generating reference white signals before and after the document reading scan.

The lens reading unit 20 is constructed of a lens 21, a prism 22, a first read substrate 24, a red channel (which will be shortly referred to as "R-ch") CCD 25, a second read substrate 26, and a cyan channel (which will be shortly referred to as "C-ch") CCD 27. The optical image of the document transmitted by the first mirror 7 and the mirrors 9 and 9' is focused by the lens 21 and is separated into an R-ch image and a C-ch image by a dichroic mirror, which is mounted in the prism 22, until they are focused, respectively, on the light receiving faces of the R-ch CCD 25, which is placed on the first read substrate 24, and the C-ch CCD 27 which is placed on the second read substrate 26.

The aforementioned fluorescent lamps 5 and 6 used are commercially available warm-white ones for preventing a specified color of a light source from being stressed or attenuated when a color document is to be read out. These fluorescent lamps are lit by a power supply of high frequency of 40 KHz so as to prevent their flickering and are maintained at a desired temperature by a heater using a posistor so as to maintain their tube walls at a constant temperature or to promote their warming-up.

The image signals outputted from the aforementioned R-ch CCD25 and C-ch CCD 27 are processed by a signal processing unit. Color signals having their colors extracted in accordance with the colors of toners are outputted from the signal processor and are inputted to the write unit B.

In this write unit B, a laser beam emitted from a semiconductor laser is rotationally scanned by using a polygonal mirror 32 which is rotated by a driving motor 30. The laser beam thus scanned has its optical path deflected through an F$\theta$ lens 36 by using a reflecting mirror 37 and is projected on the surface of a photosensitive drum 40 to form a bright line.

When the scanning operation is started, the beam is detected by an index sensor, and its modulation by a first color signal is started. The beam thus modulated is caused to scan the photosensitive drum 40, which has been charged uniformly in advance by a charging device 41. On the drum surface is then formed a latent image corresponding to the first color by both the main scan of the laser beam and the auxiliary scan of the photosensitive drum 40 being rotated. This latent image is developed by a developing device 42, which is charged with a red toner, for example, to form a toner image on the drum surface. The toner image thus obtained passes, while being retained on the drum surface, below a cleaning device 46 spaced from the photosensitive drum surface until it enters a subsequent copy cycle. The photosensitive drum 40 is charged again by the charging device 41.

Next, a second color signal outputted from the signal processing unit is inputted to the write unit B and written in the drum surface as in the aforementioned case of the first color signal to form a latent image. This latent image is developed by a developing device 43 which is charged with a blue toner, for example. This blue toner image is formed on the aforementioned red toner image formed already.

Reference numeral 44 denotes a developing device containing a black toner for forming a black toner image on the drum surface on the basis of a control signal generated by the signal processing unit. This and other developing devices 42, 43 and 44 have their sleeves biased by alternating and direct currents for conducting jumping development with two-component toners so that a noncontact development is conducted on the photosensitive drum 40 grounded to the earth.

Turning now to FIG. 3, the detail of the developing device 43 will be described in the following. This developing device 43 is composed of a toner supply **43*a*, a sponge roller 43*b*, toner agitating rotors 43*c* and 43*d*, an ear cutting plate 43*e*, a developing sleeve 43*f*, a magnet roll 43*g*, a resistor 43*h*, an a.c. power source 43*j*, and 43*k*** a d.c. power supply.

The toner supplied from the toner supply **43*a* is delivered by the actions of the sponge roller 43*b* and the agitating rotors 43*c* and 43*d* to the developing unit composed of the developing sleeve 43*f* and the developing magnet roll 43*g*. On the developing sleeve 43*f*, there is formed such a layer of developer, which is composed of the toner and its carrier, as has been regulated to have a constant thickness by the ear cutting plate 43*e*. The latent image formed on the surface of the photosensitive drum 40** is developed with that developer layer.

For example, the magnet roll **43*g* is rotated clockwise at a high speed of 1,000 r.p.m., whereas the developing sleeve 43*f* is rotated counterclockwise at a speed of 300 r.p.m. Moreover, this developing sleeve 43*f* is connected through the resistor 43*h* to the a.c. power source 43*j* and the d.c. power source 43*k* so that the developing action is conducted by applying a high-frequency voltage composed of a d.c. voltage and a superposed a.c. voltage between the developing sleeve 43*f* and the photosensitive drum 40**.

In the present invention, the developing device 43 thus used is accommodated together with the other developing devices 42 and 44 charged with the other color toners in an integral casing 70, as shown in FIG. 1, and can be arranged in a position to face the circumferential surface of the photosensitive member 40 by means 74, 75 for removably mounting each of the developing devices 42, 43, 44 on the integral casing 70 at a predetermined optimum operating position relative to the photosensitive member 40 by contact with a reference means 90, **43*l*** as will be described hereinafter.

The aforementioned integral casing 70 is built in the image forming apparatus body and is formed at its front with insertion portions which are opened in respectively unique shapes for fitting the developing devices 42, 43 and 44. After these developing devices 42, 43 and 44 have been inserted into said insertion portions, respectively, a gear 82 is turned clockwise to feed a rack 71 leftward by a (not-shown) knob which is connected to a shaft 81 borne in the apparatus body. Then, the integral casing 70 guided by a support face 84 to move leftward toward a shaft 83 supported by the apparatus body, until it is stopped at a position where edge portions 72 projecting from its two sides come into abutment against stop pins 85, which are anchored in the apparatus body at the two sides of the photosensitive drum 40.

In this position, the integral casing 70 is fixed with respect to the apparatus body such that a pair of rectangular holes 73 opened in its top face are retained by a pair of hook members 86 which are fitted on the aforementioned shaft 83 and urged counter-clockwise together with the shaft 83 by a torsion spring 87.

A means for removably mounting each developing device 42, 43, 44 on the integral casing 70 at each of its insertion portions includes resilient means in the form of: a compression spring 75 for urging the central portion of the righthand side of the developing device 43 toward drum 40; and a stationary post 74 for supporting said compression spring 75. A reference means is mounted on the integral casing and comprises a stationary pin 90 which is located at a corresponding position at the lefthand side of the developing device 43 or the like and which acts as a mounting reference member; and a variable length position adjusting screw **43*l* fastened into the developing device 43 or the like which abuts against the pin 90**.

As a result, the developing device 43 or the like is subjected to a leftward urging force by the aforementioned compression spring 75 when it is mounted in the aforementioned integral casing 70. By adjusting the aforementioned position adjusting screw **43*l*, therefore, its position relative to the stationary pin 90 acting as the mounting reference member can be adjusted to set the developing sleeve 43*f* at an optimum position for the developing function with respect to the circumferential surface of the photosensitive drum 40**.

Likewise, the aforementioned other developing devices 42 and 44 have their respective developing sleeves positioned at predetermined spacings adjusted with respect to the photosensitive drum 40.

If, on the other hand, the aforementioned hook members 86 are slightly turned clockwise by a (not-shown) release lever connected to the aforementioned shaft 83, they come out of engagement with the rectangular holes 73 so that the aforementioned integral casing 70 can be automatically moved rightward in parallel by the tension of the tension spring 76 to move the aforementioned two left edge portions 72 together with the aforementioned developing sleeve 43*f* to positions rightwardly spaced far from the circumferential surface of the photosensitive drum 40. This facilitates the mounting and demounting operations of the developing device 43 and so on or the photosensitive drum 40 and prevents their accidental contacts and damages.

The image, which is formed by superposing the toner images thus developed with the first and second color signals and the toner image developed with the black toner, is transferred by a transfer electrode 50 to a sheet of copy paper 61 which is fed by a feed belt 62 and a feed roller 63 of a paper feed unit. The copy paper thus having the toner image transferred is separated from the photosensitive member by a separating electrode 51 and is then transferred to a fixing device 52, where it is fixed to provide a color halide copy.

The cleaning device 46 is brought into contact with the photosensitive drum 40 having finished the transfer to clean it with a blade 47 thereby to clear its surface of any unnecessary toner. The cleaning device 46 has a roller 49 for removing a small quantity of toner which is left between the drum surface and the blade 47 when this blade leaves the drum surface after the end of the cleaning operation for subsequent exposure and development. The roller 49 rubs the drum surface, while rotating in the opposite direction to that of the drum, to recover the residual toner till the end of the color copying process.

Incidentally, the aforementioned integral casing 70 has built-in motors M1 and M2 whose power transmission devices are arranged at the back of the integral casing 70. When the developing devices 43 and so on are fitted in their respectively adjusted positions, the power shafts of the power transmission devices are connected to the toner supplies 43*a*, the sponge rollers 43*b*, the developing sleeves 43*f*, the magnet rolls 43*g* and so on to transmit the desired rotational motions to the same.

As has been described hereinbefore, according to the present invention, the plural developing devices can be set in their respectively adjusted positions or retracted from the same positions by the single action. As a result, the developing devices can always be held in the proper positions relative to the photosensitive member to provide the color image forming apparatus which can assure stable developing operations while facilitating safe supply of toner to the developing devices and the safe replacement of the photosensitive member.

What is claimed is:

1. A color image forming apparatus for conducting multicolor development having a body, a photosensitive drum (40) mounted on said body, an integral casing (70) mounted on said body and movable to either a fixed operating position with respect to said drum or a service position away from said drum, a plurality of developing devices (42, 43, 44) removably mounted on said integral casing, wherein the improvement comprises, a plurality of insertion portions on said integral casing, each adapted to receive one of said developing devices in an operating position, means (74, 75) for removably mounting one of said developing devices in each of said insertion portions, and a reference means (90, 43*l*) on said integral casing abuttable by each of said developing devices to locate all of said developing devices at predetermined optimum operating positions with respect to said drum, so that any one of said developing devices may be selected for operation without movement of said selected developing device or movement of said integral casing relative to said drum.

2. A color image forming apparatus according to claim 1 wherein said reference means comprises a plurality of reference members (90) mounted on said integral casing (70), said reference members being spaced apart from each other with each one of said reference members being contactable by one of said developing devices so that all of said developing devices will be located in said integral casing at their optimum operating position.

3. A color image forming apparatus according to claim 2 wherein said reference means includes a variable length position adjusting member (43*l*) mounted between each of said developing devices and its associated reference member in a location to abut one of said reference members (90) when said developing device is in its optimum operative position whereby said optimum operating position relative to said drum can be individually adjusted and set for each developing device.

4. A color image forming apparatus according to claim 3 wherein said means for removably mounting said developing devices in said insertion portions includes a resilient means (75) mounted between said integral casing and each of said developing devices for urging each of said devices toward said drum (40) and into abutment with an associated one of said mounting reference members (90).

5. A color image forming apparatus according to claim 3 wherein said variable length position adjusting member (43*l*) comprises an adjusting screw threaded into each of said developing devices.

* * * * *